US006962171B2

(12) United States Patent
Krumm et al.

(10) Patent No.: US 6,962,171 B2
(45) Date of Patent: Nov. 8, 2005

(54) DRIVE ARRANGEMENT FOR A WEAVING LOOM AND SHEDDING MACHINE

(75) Inventors: Valentin Krumm, Hergensweiler (DE); Dietmar Von Zwehl, Achberg (DE); Michael Lehmann, Lindau (DE); Dieter Mayer, Wangen (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 215 days.

(21) Appl. No.: 10/450,102

(22) PCT Filed: Nov. 22, 2001

(86) PCT No.: PCT/DE01/04412

§ 371 (c)(1),
(2), (4) Date: Jun. 10, 2003

(87) PCT Pub. No.: WO02/48438

PCT Pub. Date: Jun. 20, 2002

(65) Prior Publication Data

US 2004/0025956 A1 Feb. 12, 2004

(30) Foreign Application Priority Data

Dec. 12, 2000 (DE) ..... 100 61 717

(51) Int. Cl.[7] ..... D03D 49/50
(52) U.S. Cl. ..... 139/116.2; 139/1 R; 139/1 E
(58) Field of Search ..... 139/1 R, 1 E, 116.2

(56) References Cited

U.S. PATENT DOCUMENTS

| | | | | |
|---|---|---|---|---|
| 5,522,434 A | | 6/1996 | Lindblom | |
| 5,617,901 A | | 4/1997 | Adriaen et al. | |
| 5,642,757 A | | 7/1997 | Froment et al. | |
| 5,755,267 A | * | 5/1998 | Eberhard et al. | 139/1 E |
| 5,862,835 A | * | 1/1999 | Hellstrom | 139/1 E |
| 6,056,022 A | * | 5/2000 | Graser | 139/1 R |
| 6,102,079 A | * | 8/2000 | Croucher et al. | 139/1 R |

(Continued)

FOREIGN PATENT DOCUMENTS

BE 1000678 3/1989

(Continued)

OTHER PUBLICATIONS

Kruma et al., U.S. Appl. No. 10/415,385, filed Apr. 25, 2003. 13 pages of text, 1 sheet of drawings.

*Primary Examiner*—John J. Calvert
*Assistant Examiner*—Robert H Muromoto
(74) *Attorney, Agent, or Firm*—W. F. Fasse; W. G. Fasse

(57) ABSTRACT

A drive arrangement is constructed for permitting the separate operation of a weaving machine and a shed forming machine. The drive arrangement compensates any r.p.m. variations of the weaving machine drive and of the shed forming machine relative to the drive shaft of the respective machine. This drive arrangement permits keeping the energy drawn from the electrical supply network during the start phase and the drive power to be provided for a normal operation of the weaving machine and of the shed forming machine optimally low.

49 Claims, 4 Drawing Sheets

U.S. PATENT DOCUMENTS

| | | | | | |
|---|---|---|---|---|---|
| 6,148,870 | A * | 11/2000 | Lindblom | 139/383 AA |
| 6,164,340 | A * | 12/2000 | Krumm | 139/1 E |
| 6,186,184 | B1 * | 2/2001 | Eberhard | 139/1 E |
| 6,186,190 | B1 * | 2/2001 | Verclyte | 139/434 |
| 6,230,752 | B1 * | 5/2001 | Dornier et al. | 139/1 R |
| 6,247,503 | B1 * | 6/2001 | Shaw et al. | 139/1 E |
| 6,307,340 | B1 * | 10/2001 | Wagner et al. | 318/431 |
| 6,532,996 | B2 * | 3/2003 | Tamura | 139/1 E |
| 6,834,681 | B2 * | 12/2004 | Wahhoud | 139/1 E |

FOREIGN PATENT DOCUMENTS

| | | |
|---|---|---|
| DE | 4436424 | 4/1995 |
| DE | 19535333 | 3/1997 |
| DE | 10053079 | 5/2002 |
| EP | 0726345 | 5/1996 |
| EP | 0893525 | 1/1999 |
| EP | 1048769 | 11/2000 |
| WO | WO98/31856 | 7/1998 |

* cited by examiner

DRIVE ARRANGEMENT FOR A WEAVING LOOM AND SHEDDING MACHINE

FIELD OF THE INVENTION

The invention relates to a driving arrangement for a weaving machine and a shed forming machine with means for compensating fluctuations of the r.p.m. of the drive of the weaving and shed forming machine.

BACKGROUND INFORMATION

A drive is known from European EP-A 0,726,345 which is effective through transmission elements on a main drive shaft provided with a switching gear wheel. The switching gear wheel meshes in a first position with a gear wheel of at least one drive of the sley of the weaving machine and with a gear wheel at least for the drive of the shed forming means. In a second position the switching gear wheel meshes only with one of the two gear wheels.

A drive for a weaving machine is known from WO 98/31856. The drive of which is arranged coaxially to and directly coupled to the main drive shaft. The main drive shaft of the weaving machine is shiftable by a hydraulic or pneumatic adjustment system in one direction so that the drive power is applied only to the shed forming mechanism. Further, the main drive shaft is shiftable straight through the motor field in the opposite direction so that the drive is effective for the sley, possibly also for the grippers, as well as for the shed forming mechanism, i.e. this position of the main drive shaft is the position for the current weaving operation.

The above mentioned solutions start from a central drive and from an interlocking connection between the weaving machine and the shed forming machine in the weaving operation. Thus, all alternating moments are transmitted through the main drive shaft or at least through sections thereof. The resulting torsions cause vibrations which are transmitted onto the entire structure. Such vibrations may lead to impairments of the weaving quality. Such vibrations also have a high power consumption of the drive system and a high dead time frequency of the entire machine. Further, the interlocking connection between the weaving machine and the shed forming machine is subject to wear and tear as well as failure.

The above mentioned solutions are also disadvantageous with regard to the layout of the drive because the interlocking connection between the weaving machine and the shed forming machine require that both start simultaneously. As a result a very high start dynamic is required for avoiding start-up spots in the fabric. Such a high start-up dynamic requires drive motors with an extremely low inertia relative to their torque development. Such drives then have in most instances a thermal moment (rated moment) which is inadequate for a continuous operation so that external cooling is required, mostly with oil or water. A further disadvantage is, that the adjustment mechanisms provided in the known solutions for the switching gear wheel or respectively for the main drive shaft are additional components subject to wear and tear which additionally entail an extra maintenance effort and expense.

A drive mechanism for a weaving machine is already known from European Publication EP 0,893,525 A1, which drive mechanism comprises a weaving machine with a drive motor operating as a main motor or as an auxiliary motor, a shed forming machine with a drive motor operating correspondingly as auxiliary motor or as a main motor and a control device. The control device is constructed to follow a closed loop control strategy in order to operate the auxiliary drive relative to the main drive in a synchronous manner or with a leading or trailing angular position. The EP 0,893,525 A1 does not disclose how in such a drive mechanism fluctuations in the r.p.m. of the drive of the shed forming and weaving machine can be substantially compensated relative to the main shaft of the weaving machine and the drive shaft of the shed forming machine.

A method for driving a weaving machine is known from DE 44 36 424 A1, wherein the weaving machine main shaft is rotated with the aid of at least one electric motor drive that is coaxially connected with the main shaft. The electric motor drive is connected to a power supply network and is operatively connected with a control unit. The drive is operated by the control unit, preferably by sinusoidal control signals that are produced in the control unit in such a way that the main shaft, during a respective revolution, is rotated by the electric motor drive accelerated or decelerated with a variable rotational or angular velocity. The electric motor drive thereby is a d.c. drive which is so activated that it works at times as a d.c. motor and at times as a d.c. generator. In case the drive operates as a d.c. motor it is supplied with energy from a power supply network, and in the case that the drive operates as a d.c. generator, the electric energy produced by the drive is fed back into the power supply network.

Due to the fact that according to the known prior art, the weaving machine and the shed forming machine are driven substantially in synchronism during starting, it is necessary to provide a relatively high total energy by the power supply network during the starting phase. This circumstance is valid for weaving machines which are equipped with at least one main drive motor, whereby the drive for the shed forming machine is derived from the main drive shaft of the weaving machine. This circumstance is valid as well for weaving machines which are equipped with a drive mechanism according to EP 0,893,525 A1.

OBJECT OF THE INVENTION

It is a first object of the invention to substantially compensate the r.p.m. fluctuations of the drive of the weaving machine as well as of the shed forming machine relative to the drive shaft of the respective machine, in a drive mechanism which permits the separate operation of the weaving machine and of the shed forming machine.

It is a second object of the invention, by including the solution of the first object, to lay out the starting phase of a weaving and shed forming machine in such a way that the energy taken out of the power supply network and the required drive power to be installed can be kept as small as possible.

SUMMARY OF THE INVENTION

In the following description the term "current operation" is used. This term denotes the operation of a machine or machine system from the completion of the run-up until the beginning of the stopping operation. If the current operation of a weaving and/or shed forming machine takes place with a fabric, the term denotes a weaving operation. Thus, the term "weaving operation" is encompassed by the term "current operation".

According to the invention the first object has been achieved by the combination of the following features. The drive shaft of the shed forming machine is equipped with additional flywheel masses that are effective on the drive shaft. In the simplest embodiment the flywheel masses are bodies of rotational symmetry connected to the drive shaft and having a homogenous density so that r.p.m. fluctuations of the drive of the shed forming machine are compensated as much as possible relative to the drive shaft, i.e. the quotient of the maximum and minimum instantaneous value of the mass inertia moment is substantially reduced. In accordance with the rule of the conservation of the moment of momentum, these flywheel masses, which are additionally effective on the drive shaft, cause a substantially smaller natural r.p.m. fluctuation at the drive shaft of the shed forming machine. As a result the positive and negative acceleration moments required in the current operation diminish accordingly for the r.p.m. closed loop control or for the position closed loop control of the shed forming machine. Consequently, the necessary thermal dimensioning moment or rated moment of the drive motor and the current consumption of the drive out of the power supply network are reduced. An additional load reduction for the drive motor during current operation becomes possible due to the fact that the avoiding of the positional synchronism between the shed forming machine and the weaving machine outside of the critical machine angular ranges, permit the natural oscillation of the drive shaft of the shed forming machine in accordance with the rule of conservation of the moment of momentum. Thus, the load moments on the drive shaft are formed only by the warp threads, by the friction related losses and by the closed loop control to the required operational r.p.m. for the following critical machine angular range.

The basis for the solution of the second object is the fact that the above mentioned avoiding of the positional synchronism between the shed forming machine and the weaving machine permits a decoupling of the two run-up characteristics according to DE Patent Application 100 53 079 to the extent that first the shed forming machine is started and accelerated relatively slowly to the operational r.p.m. for linking with the later starting weaving machine that is accelerated relatively fast for linking in time, prior to the first reed beat-up of the weaving machine, whereby the link-up must take place within the permissible r.p.m. and positional tolerances for the current operation, particularly a weaving operation.

The reverse is true correspondingly in that, compared to the weaving machine, a slower braking action can be applied to return the shed forming machine to a stillstand. See in this connection the German Patent Application DE 100 53 079. As a result, the required acceleration and braking moments for the drive of the shed forming machine can be reduced. Therefore, and due to the above mentioned degrees of freedom in the motion during current operation it is not necessary to dynamically optimize the characteristics of the drive motor of the shed forming machine. Rather, the drive motor of the shed forming machine can now be optimized with regard to consumption. On the other hand, the drive of the main drive shaft of the weaving machine can now also be made smaller because it is relieved by the shed forming machine and because it is additionally favored by the lighter construction of respective gear stages of the weaving machine. The acceleration moment particularly required for the starting operation has become smaller.

However, according to the invention it is provided to outfit the main drive shaft with additional flywheel masses that are effective on the main drive shaft. These flywheel masses are constructed in the simplest form as bodies of rotational symmetry and homogeneous density so that these flywheel masses compensate the r.p.m. fluctuations of the weaving machine drive, relative to the main drive shaft, to the largest possible extent, i.e. the flywheel masses substantially reduce the quotient of the maximum and minimum instantaneous value of the mass inertia moment. It is true that these additional masses increase again the required acceleration moment. However, these masses have the same positive effects on the drive layout as in the shed forming machine. Furthermore, the distribution of the additional masses to both sides of the weaving machine main drive shaft reduces the occurrence of the vibrations that are caused by the torsion of the main drive shaft, whereby the disadvantages mentioned above connected with these vibrations are also reduced.

In addition to the partial compensation of the r.p.m. fluctuations of the drive, a complete compensation of these fluctuations is also possible if the effect of the additional masses is transmitted through compensation gears to the main drive shaft of the weaving machine or to the drive shaft of the shed forming machine. The additional masses are preferably constructed as rotation symmetric bodies having a uniform mass distribution and a homogenous density. The layout of such a compensation gear, even in connection with the intended reduction of machine vibrations, is performed in accordance with mathematical rules documented in detail in the technical literature as is known.

Furthermore, for solving the second object the invention provides to configure the start of the shed forming machine that begins prior to the start of the weaving machine, in such a way that the following start of the weaving machine is supported on the one hand by the drive of the shed forming machine and on the other hand by the kinetic energy imposed on the shed forming machine. Furthermore, the second object is solved according to the invention by the features of patent claim 23. Thereby a drive suitable for the standstill operation is allocated to the shed forming machine in such a way that its stator or its rotor is coupled in an interlocking manner with the main drive shaft of the weaving machine and preferably coaxially thereto or through gear drives, while inversely its rotor or stator is coupled in an interlocking manner with the drive shaft of the shed forming machine, preferably coaxially or through gear drives. Furthermore, there is a possibility of brake locking or arresting the main drive shaft of the weaving machine in such a way that the drive shaft of the shed forming machine remains freely movable. For the first taking place run-up of the shed forming machine, the above described drive is connected to power while simultaneously the main drive shaft of the weaving machine remains brake locked. Thus, the power effect between the stator and the rotor of the drive, i.e. the torque moment, serves for the run-up of the shed forming machine. Thereby the shed forming machine is accelerated, preferably up to an r.p.m. above that r.p.m. which is required for the weaving operation because a portion of its kinetic energy is withdrawn again for the subsequent start of the weaving machine. For starting the weaving machine the brake locking or arresting of its main drive shaft is released. Simultaneously, the drive of the shed forming machine is supplied with current in such a way that—in the case of three phase motors—the moment forming rotary field, depending on the motor type, has a frequency either decreasing rapidly starting from the r.p.m. of the shed forming machine, or it has set from the beginning, a very small value or a 0 Hz frequency. In this connection attention needs to be paid to the fact that the frequency of the rotary field is defined by the r.p.m. difference between the stator and the rotor. That means that in the case of a synchronization at a frequency of 0 Hz the rotary field has the tendency to reduce the r.p.m. frequency between stator and rotor to $0_{rads}^{-1}$ or to keep it at $0_{rads}^{-1}$. Thus, a torque moment is imposed on the weaving machine, said torque moment having the tendency to synchronize the weaving machine with the shed forming machine with regard to the r.p.m. However, an additional drive may be directly allocated to the weaving machine, which drive supports the run-up of the weaving machine. For this purpose the additional drive is correspondingly matched in a control technical sense with the drive of the shed forming machine. In the current weaving operation this drive compensates primarily the losses caused by friction, beat-up and so forth of the weaving operation by a respective energy supply, while the drive of the shed forming machine functions primarily as a contactless clutch between the weaving machine and the shed forming machine, i.e. it assures its position synchronous operation. The braking operation takes place correspondingly inversely compared to the starting operation. Basically, non three-phase motors may also be used, whereby the moment control or closed loop control is matched for this purpose with the above described operations.

The mentioned advantages resulting from the reduction of the peak moments, i.e. the uniformization of the load characteristic, and from the reduction of the necessary acceleration and brake moments, arise not only for the drive motors of the weaving machine and for the shed forming machine, but also arise for the dimensioning of the adjustment member or inverter of the respective drive.

Fabrics having a substantial variation in the binding per pattern repetition are capable, depending on the warp threads, of generating strongly different load moments from cycle to cycle. hereby, a "cycle" is defined as a full revolution of the main drive shaft of the weaving machine from one reed beat-up to the next reed beat-up.

In order to make the requirement for moments more uniform over the entire pattern repetition, an r.p.m. difference between cycles having different bindings is permitted. For synchronizing the shed forming machine in the critical machine angular range, it is necessary that the weaving machine follows this r.p.m. fluctuation accordingly, whereby kinetic energy differences of the weaving reed are possible in the critical machine angular range. The separation of the drives for the shed forming machine and for the weaving machine, which as such is known, satisfies the requirement for a constantly uniform quality of the weft beat-up by the reed in that the mentioned differences in the kinetic energy of the reed are compensated by a respective displacement of the shed closure with reference to the machine angle. The displacement of the shed closure for influencing the weft beat up can be advantageously used also for fabrics which, mostly depending on the weft thread, require variable operating r.p.m.s.

In an embodiment according to the invention the shifting of the shed closure is achieved in that between the stator and the rotor of the drive of the shed forming machine a torque moment is achieved, by a respective power supply, which does not have any synchronizing effect, for producing a coupling effect, but rather has a repulsive effect for forming a differential speed. It is also possible to use a brief switch off of this drive with the current being zero for the angular shift between the weaving machine and the shed forming machine.

A further advantageous embodiment of the invention involves dividing the drive for the weaving machine onto both machine sides or even to segmentize and distribute the drive over the entire length of the main drive shaft. In both instances it is possible to actively counteract particularly a varying torquing of the main drive shaft and thus to counteract the vibrations connected therewith, by a differentiated control of the partial drives.

Further there is the possibility of connecting the intermediate circuits of the actuators or inverters of the shed forming machine and of the weaving machine. Thus, the feed back energy of one drive can be used as drive energy for the respective other drive. This also provides advantages for the loading of the power supply network during the start of the weaving machine. The optimization of the mutual energy supply between shed forming machine and weaving machine is thereby achieved by the following features which include a respective formation of the degrees of freedom of the motion in the non-critical machine angular range, the respective formation of the mass inertia moment characteristic of the weaving machine and of the shed forming machine relative to one another and the respective layout of the above mentioned additional masses. These measures make sense for the minimizing and uniformizing the power input from the power supply network even if the above mentioned common intermediate circuit is not provided. From a drive technical view the invention achieves the following advantages.

- compared to conventional solutions, the entire machine including the weaving machine and the shed forming machine has a smaller current input for its operation;
- the possibility of avoiding additional cooling for the drive motors by reducing the thermal dimensioning moments while achieving an equal useful output compared to the prior art;
- due to the additional masses in the weaving machine and in the shed forming machine the inherent kinetic energy of the machines increases, thereby increasing the indifference to weak or variable electrical power supply networks during current operation. This applies particularly to the embodiments according to the invention as defined in claims 1 and 23, because here the drives, which function as a coupling between the weaving machine and the shed forming machine, maintain the synchronism between the weaving machine and the shed forming machine with a low power requirement. In the case of the embodiment according to claim 23 the weaving machine drive can function as a supply generator, even when the power supply network completely fails, to thereby supply the power required for the drive of the shed forming machine. The drive of the shed forming machine functions as a coupling. This power supply is based on a portion of the kinetic energy of the weaving machine and of the shed forming machine.

Furthermore, the arrangements according to the invention make possible a higher insensitivity to weak or fluctuating electrical power supply networks during the starting phase and thus also during the braking phase because for the critical weaving machine start the kinetic energy of the shed forming machine is also utilized. For example, when the power supply network has a voltage lower than the rated voltage of the network, the shed forming machine is accelerated to a higher r.p.m. so that the shed forming machine with its higher kinetic energy compensates the lower energy supply from the power supply network.

BRIEF DESCRIPTION OF THE DRAWINGS

The invention will be described in more detail in the following with reference to example embodiments, wherein.

DETAILED DESCRIPTION OF PREFERRED EXAMPLE EMBODIMENTS AND OF THE BEST MODE OF THE INVENTION

Figure 1:
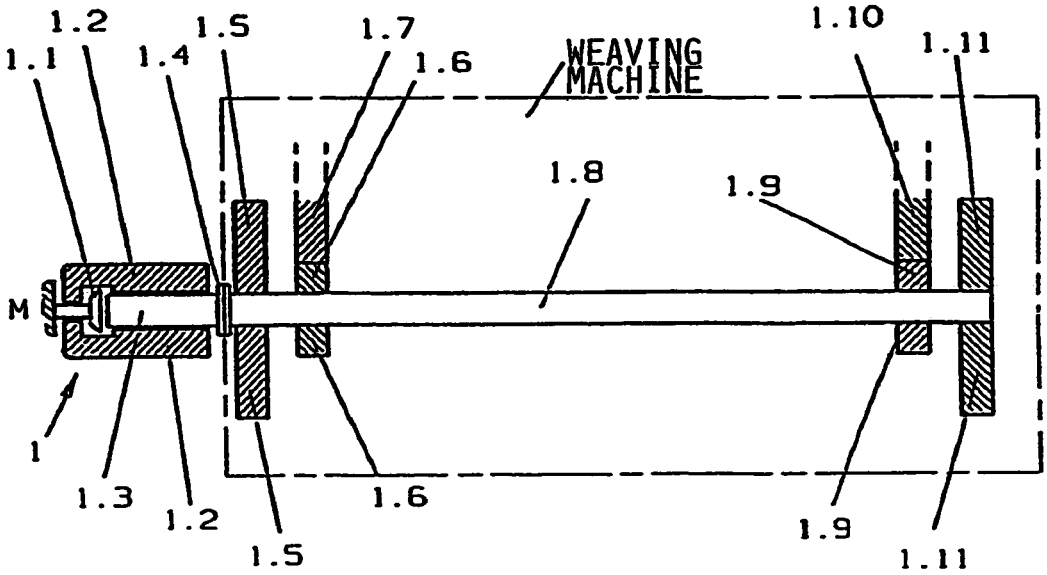
FIG. 1 shows a schematic illustration of a drive arrangement for a weaving machine with flywheel masses rigidly secured to the main drive shaft of the weaving machine.

In FIG. 1 the main drive shaft 1.8 of a weaving machine is moved by a drive motor 1 comprising a stator 1.2, a rotor 1.3, and the integrated brake 1.1, whereby the latter normally performs merely the function of a holding brake for the machine stillstand. The rotor and the main drive shaft are rigidly coupled to each other through the coupling 1.4. Further, gear wheels 1.6 and 1.9 are rigidly mounted on the main drive shaft and mesh with the gear wheels 1.7 or 1.10 respectively. 1.6 and 1.7, as well as 1.9 and 1.10 thus represent the left or the right gear side of a weaving machine. The additional flywheel masses 1.5 and 1.11 are also rigidly mounted on the main drive shaft 1.8. The flywheel masses serve primarily for compensating the r.p.m. fluctuations of the drive of the weaving machine.

Figure 2:
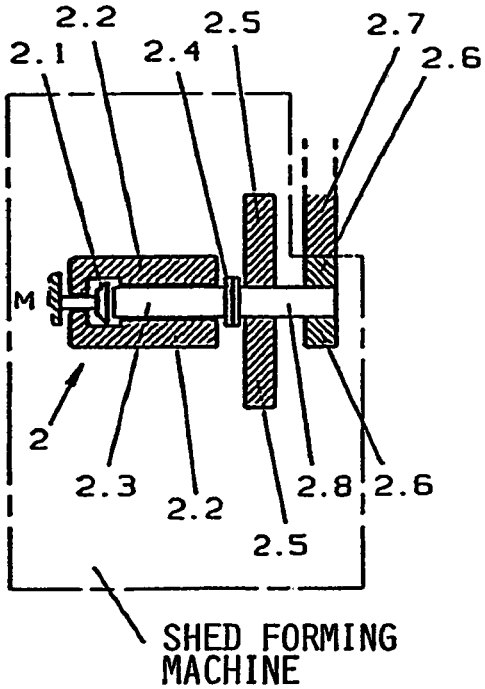
FIG. 2 shows a schematic illustration of a drive arrangement for a shed forming machine with a flywheel mass rigidly secured to the drive shaft of the shed forming machine.

According to FIG. 2 the drive shaft 2.8 of a symbolically illustrated shed forming machine is driven by a separate drive motor 2. This drive motor comprises a stator 2.2 and a rotor 2.3 as well as the integrated brake 2.1, whereby the latter normally performs the function of a holding brake for the machine standstill. The rotor 2.3 and the drive shaft 2.8 are rigidly coupled to each other through the coupling 2.4. Further, the gear wheel 2.6 is rigidly mounted on the drive shaft. The gear wheel 2.6 meshes with the gear wheel 2.7. 2.6 and 2.7 thus represent the gear of the shed forming machine. The additional flywheel mass 2.5 is also rigidly mounted on the drive shaft 2.8. The flywheel mass 2.5 serves primarily for the compensation of the r.p.m. fluctuations of the drive of the shed forming machine.

The symbol M means that the brakes 1.1 or 2.1 cause a locking of the respective machine relative to a "mass", i.e., relative to the machine frame or the floor. For a better illustration all components of the example embodiments are shown in section in FIGS. 1 and 2 with the exception of 1.1, 1.3, 1.4, 1.8 and 2.8.

Figure 3:
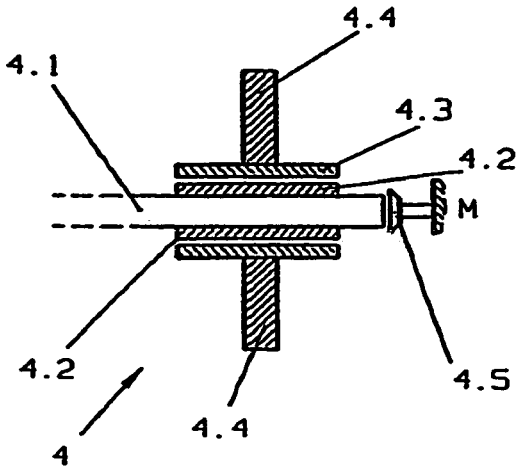
FIG. 3 shows a flywheel mass that can be coupled to a rotationally driven shaft.

FIG. 3 shows a flywheel mass 4.4 that can be coupled or decoupled relative to the shaft 4.1 by means of a contactless coupling comprising the parts 4.2 and 4.3. Instead of the coupling a motor suitable for stillstand operation can be used, whereby 4.2 would be the stator and 4.3 the rotor (principle of the outer rotor motor) or 4.3 can be the stator while 4.2 is the rotor. Preferably, by using a motor and a suitable actuator for example an inverter, it is possible to control or control in closed loop fashion the torque moment effective between 4.2 and 4.3. In this manner the torsion of the shaft 4.1 can be reduced and/or be made more uniform, thereby also vibrations of the shaft are reduced, thereby improving its quiet running.

Furthermore, when a motor is used there is also the possibility of supporting the run-up and the stopping (applying a braking action until standstill is achieved) of a working machine weaving and/or shed forming machine that is coupled with 4.1 in an interlocking manner. Alternatively, another drive can be supported when a motor is used. For the run-up, the motor 4 comprising 4.2 and 4.3 is supplied with power in such a way that with its electrically produced torque moment an acceleration of the flywheel mass 4.4 to a target r.p.m. $\omega_{41}$ takes place. During run-up the working machine is preferably brake-locked, and thus its shaft 4.1, is brake locked, see holding brake 4.5. Thereafter, the brake 4.5 of the working machine is released and motor 4 supplied with power in such a way that its electrically produced torque moment works toward reducing the differential r.p.m. between the flywheel mass 4.4 and the shaft 4.1 to $0_{rads}^{-1}$. Thereby, an energy equalization between the flywheel mass and the working machine takes place, i.e. the flywheel mass supplies energy to the working machine so that eventually the flywheel mass 4.4 and the shaft 4.1 rotate at a synchronized r.p.m. of $\omega_{42}$, whereby without any further measures the relationship $\omega_{42}<\omega_{41}$ applies. The motor 4 now works as a contactless coupling. The stopping takes place in reverse relative to the run-up. That means that first the motor 4 is supplied with current in such a way that its electrically produced torque moment works toward achieving a differential r.p.m. between 4.4 and 4.1 in such a way that the effect of this torque moment applies a braking action down to standstill. In connection with low loss working machines, reversely, the r.p.m. of the flywheel mass is again increased. Allegorically one can say that during run-up of the working machine the flywheel mass 4.4 and the shaft 4.1 attract each other while during stopping of the working machine they repel each other.

When the working machine has been braked down to standstill, the holding brake becomes effective again for brake locking the working machine. Naturally, following the complete stopping of the working machine, 4.4 can run out or it can be stopped through the motor 4 with a respective small feedback power.

Basically, there is the possibility, as a result of using the motor 4 as a coupling, by means of this motor and the above mentioned actuator to recover the energy generated by the working machine and the flywheel mass during a braking action, rather than converting that energy through brake resistances into a heat loss. Rather, the recovered energy is fed back, in the manner of a generator, i.e. as a useful braking action, into an electrical supply network and/or it is stored in capacitors and/or other energy storing types. When laying out the brake 4.5 it is further to be taken into account that the brake, although being a holding brake, must have a holding moment that is large enough to assure the standstill of the working machine against the acceleration and deceleration moments that are effective during the run-up and again stopping process of 4.3 and 4.4. The symbol M has the same meaning as in FIG. 1.

Figure 4:
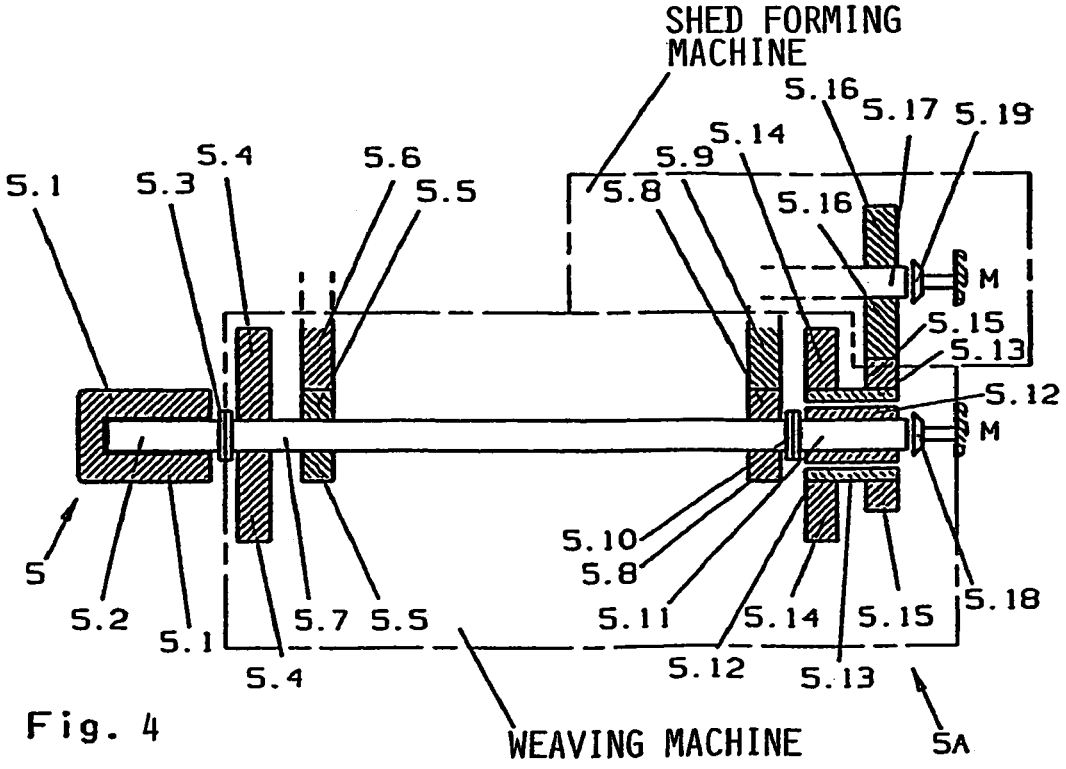
FIG. 4 shows a driving arrangement for weaving machines with a first and a second partial drive.

FIG. 4 illustrates an arrangement which comprises, first of all, a weaving machine drive 5 including a stator 5.1 and a rotor 5.2 which is rigidly connected through the coupling 5.3 with the main drive shaft 5.7 of a weaving machine. Further, gear wheels 5.5 and 5.8 are rigidly mounted on the main drive shaft. The gear wheels 5.5 and 5.8 mesh in turn with the gear wheels 5.6 or 5.7 respectively. 5.5 and 5.6 respectively 5.8 and 5.9 represent thus the left gear side or the right gear side of the weaving machine. The additional flywheel mass 5.4 is also rigidly mounted on the main drive shaft 5.7. The flywheel mass 5.4 serves primarily for the compensation of the r.p.m. fluctuations of the drive of the weaving machine.

Further, the main drive shaft is rigidly connected through a coupling 5.10 with a shaft 5.11 which in turn carries in a rigid connection a component 5.12 which functions electrically either as a rotor or stator of a motor. Correspondingly, the component 5.13 then functions as a stator or a rotor so that 5.12 and 5.13 together provide a motor 5.A. This motor is suitable for a standstill operation and is operated with a respective actuating member in such a way that the torque moment and/or the mechanical angular velocity between stator and rotor is controllable or controllable in closed loop fashion.

The flywheel mass 5.14 and a gear wheel 5.15 are rigidly mounted on the component 5.13, whereby the gear wheel 5.15 again meshes with the gear wheel 5.16. 5.15 and 5.16 form a gear stage of the shed forming machine. The gear wheel 5.16 is rigidly mounted on the drive shaft 5.17 of the shed forming machine. A brake 5.18 normally functions as a holding brake for the shaft 5.11 and thus for 5.7 and 5.2. The brake 5.19 functions normally as a holding locking brake for 5.17. The symbol M has the same connotation as in FIG. 1. It should be pointed out that the components 5.11 and 5.12 can be structurally and functionally integrated into a single component, i.e. just as the rotor 5.2 through 5.3, the rotor or stator of the motor 5A shown with 5.12 and 5.13 is then also coupled through 5.10 directly with the main drive shaft 5.7.

Figure 5:
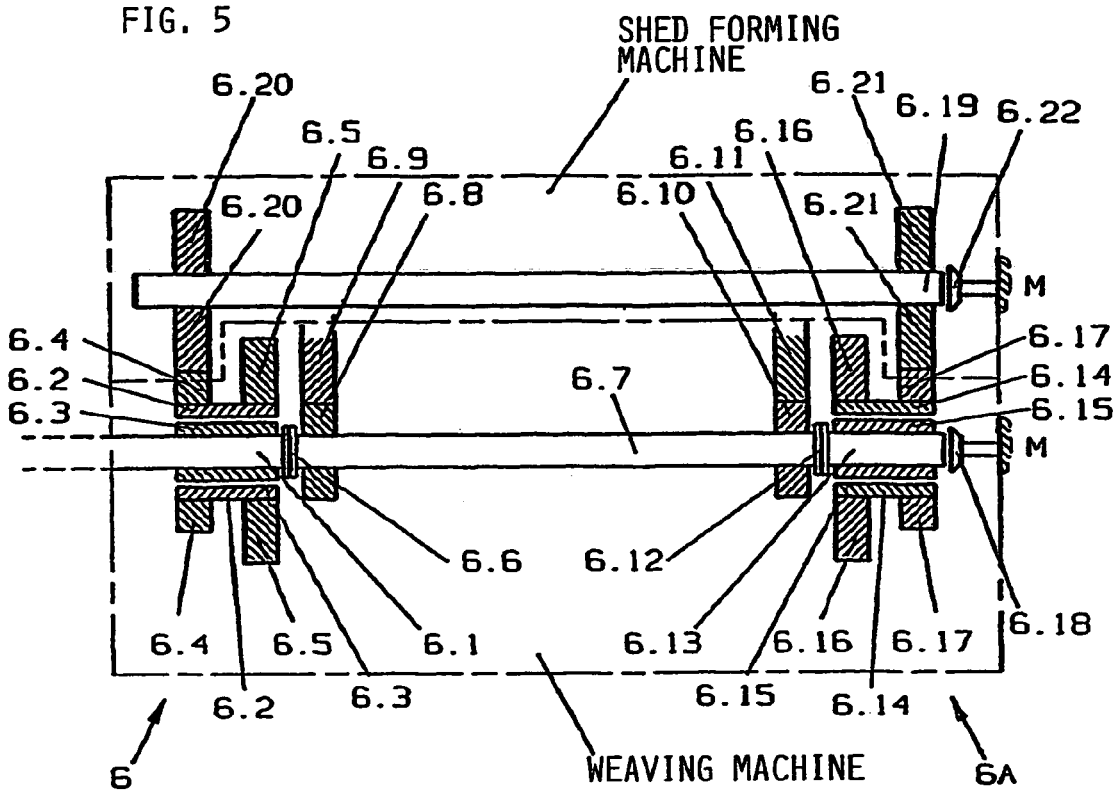
FIG. 5 shows an arrangement that differs from the drive arrangement for weaving machines according to FIG. 5.

When starting the arrangement according to FIG. 5, the motor formed by 5.12 and 5.13 and allocated as a drive to the shed forming machine, is supplied with current while the brake 5.19 is opening. Since the brake 5.18 remains locked, 5.13 starts rotating about 5.12, whereby simultaneously through 5.13, the flywheel mass 5.14 and the gear wheel 5.15 are caused to rotate. Thus, the gear wheel 5.16 and the drive shaft 5.17 of the shed forming machine also rotate. Thus, the shed forming machine is accelerated through the motor 5A that is formed by 5.12 and 5.13, to an r.p.m. $\omega_{FBM}$, which may be referenced to gear wheel 5.15. This r.p.m. is preferably somewhat higher than the later operational r.p.m. $\omega_{Betr}$ desired for the main drive shaft 5.7. When $\omega_{FBM}$ is reached, and while the brake 5.8 opens, the motor comprising 5.12 and 5.13 is supplied with current in such a way that a differential angular velocity of $0_{rads}^{-1}$ is achieved between rotor and stator through the torque moment electrically produced by the motor. In the case of a three phase motor this means that the moment forming rotary field, depending on the motor type, has a frequency that either decreases rapidly starting with the r.p.m. of the shed forming machine, or which is initially set at very small values or at 0 Hz. In this manner the main drive shaft 5.7 of the weaving machine receives an acceleration moment, the weaving machine runs up, whereby this run-up operation, correspondingly synchronized, is supported by the motor 5 formed by 5.1 and 5.2.

Since the motor formed of 5.12 and 5.13 works to achieve a differential angular velocity of $0_{rads}^{-1}$ between the rotor and stator, it also works to function as a contactless coupling between the weaving machine and the shed forming machine. Therefore, simultaneously with the acceleration of the weaving machine an r.p.m. reduction takes place for the shed forming machine, i.e. the shed forming machine is decelerated. In order that both machines meet at the desired operational r.p.m. $\omega_{Betr}$, the above mentioned, preferably initial acceleration of the shed forming machine took place to an r.p.m. $\omega_{FBM}>\omega_{Betr}$. The ratio between the acceleration of the weaving machine and the deceleration of the shed forming machine is primarily determined by the ratio of the mass inertia moments of both machines. By selecting the additional free wheeling masses it is thus possible to influence the run-up process and the ratio $\omega_{FBM}$ to $\omega_{Betr}$ within wide limits. If $\omega_{FBM}$ may not or shall not be larger than the subsequent operational r.p.m. $\omega_{Betr}$, then it is necessary, with the starting of the weaving machine, to supply to the entire system including the weaving machine, the shed forming machine and respective drives as well as additional masses, a respective additional energy for compensating the above described reduction of the r.p.m. of the shed forming machine. First, this is possible during the start of the weaving machine by the motor 5 and/or the motor 5A, but second it is also possible by the motor 5A even after the completed run-up of the weaving machine, whereby in the second case the motor 5 keeps the main drive shaft 5.7 of the weaving machine at the operation r.p.m. against the feedback moment produced by 5A. In the second case attention must be further paid that the shed forming machine must still lead in the machine rotational angle, relative to the weaving machine that has run-up, to such an extent that only with the reaching of the operational r.p.m. by the shed forming machine both machine rotational angles meet within the required tolerance window.

By supplying current to the motor that is formed by 5.12 and 5.13, for a limited time in such a way that a differential angular velocity of $0_{RADS}^{-1}$ is aimed at between the rotor and the stator through the electrically produced torque moment, it becomes possible during a current operation, i.e. also during a weaving operation, to adjust the phase position between the main drive shaft of the weaving machine and the drive shaft of the shed forming machine in both directions. The phase position is defined by the respective rotational angle. Thereby the control or the closed loop control of the motor takes place so that upon reaching the desired new phase position, a return to the coupled operation has taken place. During the adjustment operation the motor 5 formed by 5.1 and 5.2 must also be controlled or controlled—respectively synchronized—in closed loop fashion.

The braking operation takes place in reverse to the starting operation. More specifically, first the weaving machine is subjected to a braking action down to standstill by a corresponding power supply to the motors 5 and 5A formed by 5.1 and 5.2 or by 5.12 and 5.13, respectively. Upon reaching standstill the brake 5.18 becomes effective. During the braking of the weaving machine the r.p.m. of the shed forming machine rises again—in low loss machines—, in a respective reversal to the above described starting operation. Beginning with this r.p.m. and beginning from the standstill of the weaving machine, the shed forming machine is decelerated by the motor formed by 5.12 and 5.13.

The motors and the actuators allocated to the motors must convert the energy delivered by the working machines into a heat loss through braking resistors. Alternatively, the motors must permit a generator operation that provides a useful braking action for preferably feeding back energy into an electric power supply network and/or to store the energy in capacitors and/or other energy storing types.

In connection with the layout of the brake 5.18 it is to be taken into account that although being a holding brake, it must have a holding moment that is so large that it assures the standstill of the main drive shaft 5.7 of the weaving machine and of all components connected therewith in an interlocking manner. The standstill must be assured against the acceleration and deceleration moments that are effective during the run-up and during the stopping again operation of the shed forming machine.

As a matter of principle, the arrangement according to FIG. 4 can also be operated in such a way that the components 5.12 and 5.13 of the motor 5A rotate opposite to each other in the current operation. More specifically, 5A does not act as a coupling, but rather the angular velocity between 5.12 and 5.13 corresponds to the sum of the operational r.p.m.s of the weaving machine and of the shed forming machine or their multiples depending on the gears.

FIG. 5 shows an arrangement which is distinguished from that of FIG. 4 substantially in that the motor of FIG. 4 formed of 5.12 and 5.13 is divided into two motors 6, 6A. One motor 6 formed of 6.2 and 6.3 is arranged on the left of the left gear of the weaving machine. Hereby the left gear is represented by the gear wheel 6.8 that is rigidly mounted on the main drive shaft 6.7 of the weaving machine and by the gear wheel 6.9 that meshes with this gear wheel. The other motor 6A formed of 6.14 and 6.15 is arranged on the right side of the right gear of the weaving machine. This right gear is hereby represented by the gear wheel 6.10 that is rigidly mounted on the main drive shaft 6.7 of the weaving machine and by the gear wheel 6.11 that again meshes with this gear wheel. The coupling between the components 6.3 or 6.15 of the mentioned motors and the main drive shaft 6.7 takes place in that 6.3 is first of all rigidly connected with the shaft 6.1 and that 6.15 is rigidly connected with the shaft 6.13 while 6.1 is rigidly connected through coupling 6.6 with 6.7 and 6.13 is rigidly connected through coupling 6.12 with 6.7. The integration of 5.11 and 5.12 to a single component as mentioned with reference to FIG. 5 is also possible between 6.1 and 6.3, as well as between 6.13 and 6.15.

Furthermore, the main drive shaft or the drive shaft of the weaving and/or shed forming machine may be generally utilized directly as a rotor or stator. In that case the couplings 6.6 and 6.12 are obviated. Items 1.4, 2.4, 5.3 and 5.10 shown in the above mentioned Figs. could also be obviated. For maintenance reasons it is advantageous to arrange for a demounting of the electrical drive units from the main drive shaft or from the drive shaft of the weaving or shed forming machine. The flywheel mass 6.5 is rigidly connected with 6.2. The flywheel mass 6.16 is rigidly connected with 6.14. The arrangement according to FIG. 5 is particularly advantageous if the drive of the shed forming machine can be accomplished from two positions. Thereby, this drive takes place advantageously from the left-hand side and from the right-hand side of the drive shaft 6.19. Accordingly, in FIG. 5 the gear wheel 6.4 is rigidly connected with 6.2 and again meshes with the gear wheel 6.20 which, on its part, is rigidly connected with the drive shaft 6.19 of the shed forming machine. Further, gear wheel 6.17 is rigidly connected with 6.14 and in turn meshes with gear wheel 6.21 which, on its part is rigidly connected with 6.19.

The run-up, the operational control, and the stopping of the shed forming machine thus take place with a moment introduction on both sides or with a moment withdrawal from both sides. For this purpose the left-hand and the right-hand drive unit must be correspondingly synchronized. For tracking machine losses and for supporting the run-up as well as the stopping of the weaving machine, a motor according to FIG. 5 is preferably used. Such motor is formed of 5.1 and 5.2 and is preferably rigidly connected through a coupling 6.1 and correspondingly operated in synchronism with the other drives. The symbol M has the same connotation as in FIG. 1.

Figure 6:
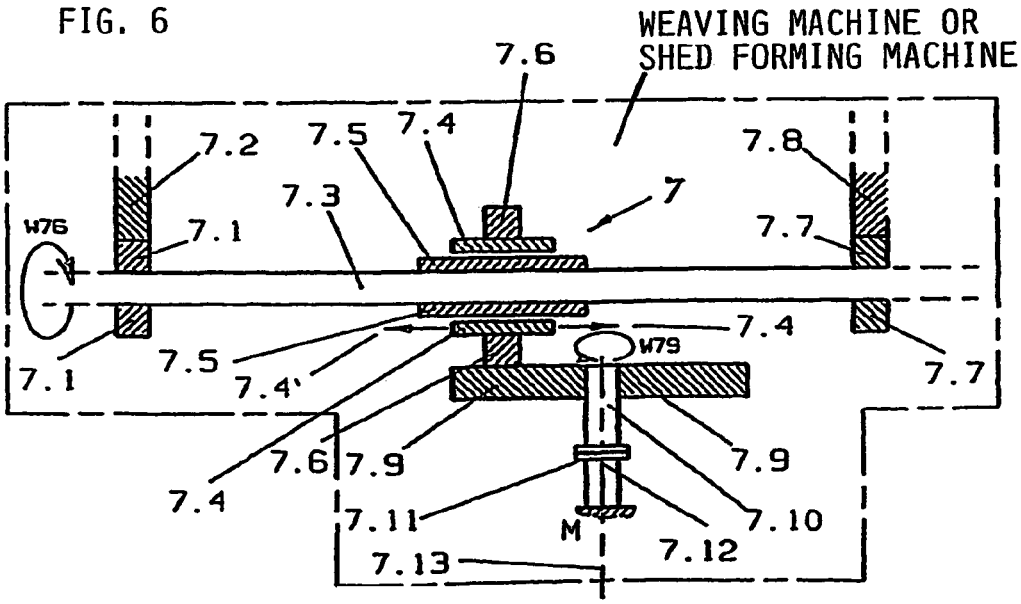
FIG. 6 shows a drive arrangement for a weaving or shed forming machine, whereby the drive shaft is a part of a linear motor.

A shaft is illustrated in FIG. 6, preferably the main drive shaft or drive shaft of a weaving machine or shed forming machine. The gear wheels 7.1 and 7.7 are rigidly connected with this shaft 7.3. 7.1 meshes on its part again with gear wheel 7.2. 7.7 meshes with gear wheel 7.8. Further, the component 7.5 is rigidly mounted on the shaft 7.3. The component 7.5 functions electrically as a stator or as a runner of a linear motor. Respectively reversed, 7.4 forms the electrical runner or stator of this linear motor, whereby the runner function is preferred for 7.4. The arrows 7.4' marked on both sides next to 7.4 symbolize the linear motion. A rotational member 7.6 is rigidly connected with 7.4 and is preferably constructed as a friction wheel. 7.6 is preferably connected by friction in a force transmitting manner with the rotational member 7.9 functioning as a flywheel mass and preferably also constructed as a friction wheel. The components 7.6 and 7.9 thus form a transmission adjustable in a stepless manner. Due to the adjustable transmission ratio between 7.6 and 7.9 it is possible to adjust the mass inertia moment effective from the component 7.9 relative to the component 7.3.

Such an arrangement is helpful when the r.p.m. needs to be changed during operation as is frequently required by the type of weaving. In the same manner the machine can start up initially against a mass inertia moment that is small relative to 7.3 while during the current operation the r.p.m. related ratio $Ü=\omega_{76}:\omega_{79}$ between 7.6 and 7.9 is made smaller. That is, 7.4 changes with 7.6 its position in the direction of the rotational axis of 7.9. Due to this reduction, the mass inertia moment of 7.9 increases in size relative to 7.3 because it is effective relative to 7.3 with the factor $1:Ü^2=1:Ü^{-2}$. 7.9 is rigidly connected with the shaft 7.10. 7.10 in turn is connected with the shaft 7.12 through a bearing 7.11 rotatable endlessly in both directions. The shaft 7.12 is in turn connected with mass, whereby the mass or symbol M has been explained above with reference to FIG. 1. For stopping the machine, Ü is preferably minimized. The machine thus reduces its velocity on its own in accordance with rule of conservation of the moment of momentum, whereby an operating brake is noticeably relieved, even though the kinetic energy to be taken up by the brake remains unchanged by the change of Ü.

A further suitable measure for supporting the run-up and again stopping the respective machine resides in the fact that between 7.4 and 7.5 there is not only a translatory, namely linear motion, but additionally also a rotational motion possible. This rotational motion is preferably accomplished in an electrical manner, that is by a respective power supply. 7.4 and 7.5 then form in addition to the function of the linear operation, a drive that is suitable for the standstill operation and as a coupling in the manner of 5.12 and 5.13 in FIG. 4. For the run-up the shaft 7.3 is stopped and 7.9 is first accelerated to a respective r.p.m., whereupon the kinetic energy of 7.9 is utilized for the run-up of the machine that belongs to the shaft 7.3. Stopping the machine again takes place correspondingly in reverse or in that no torque moment is effective between 7.4 and 7.5 due to the interruption of the respective power supply, whereby the machine and the flywheel mass 7.9 are decoupled from each other. The curved arrows show the directional relationship between $\omega_{76}:\omega_{79}$. If $\omega_{76}$ changes the direction so does $\omega_{79}$ also.

Figure 7:
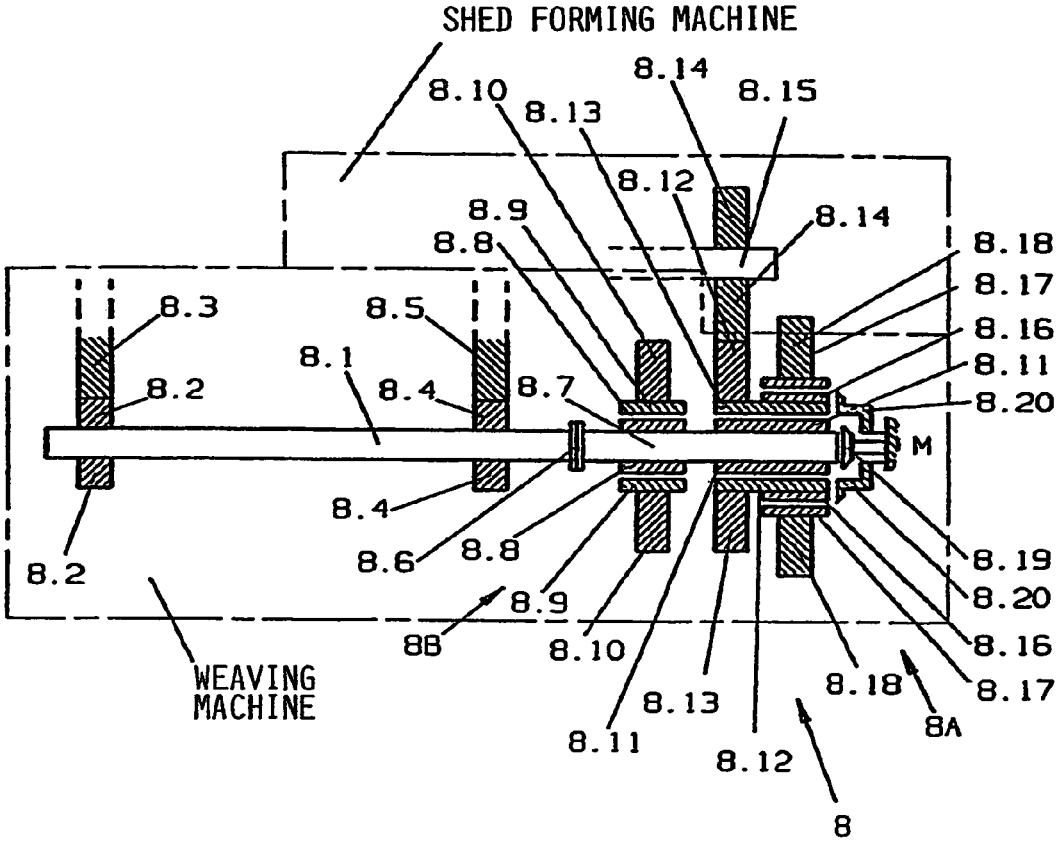
FIG. 7 shows a drive arrangement for weaving machines with one drive and two flywheel masses which are effective through additional drives.

FIG. 7 shows an arrangement which preferably also can be operated in the manner as last described for FIG. 5. The arrangement comprises the main drive shaft 8.1 of a weaving machine on which shaft the gear wheels 8.2 and 8.4 are rigidly mounted and, in turn, mesh with the gear wheels 8.3 and 8.5. 8.2 and 8.3 or 8.4 and 8.5 respectively represent the left or right gear side of the weaving machine. Further, 8.1 is rigidly connected to the shaft 8.7 by the coupling 8.6. The shaft 8.7 in turn carries two components 8.8 and 8.11 in a rigid connection. Components 8.8 and 8.11 must be viewed as functionally separate from each other. The component 8.8 functions electrically as a rotor or stator of a motor. Correspondingly, component 8.9 functions as a stator or rotor so that 8.8 and 8.9 together form a motor 8.B. The component 8.9 is on its part rigidly connected with the flywheel mass 8.10. The component 8.11 also functions electrically as a rotor or stator of a motor. Correspondingly, the component 8.12 functions as a stator or rotor so that 8.11 and 8.12 together form a motor 8. Further, the component 8.16 is rigidly connected with 8.12. The components 8.16 functions electrically either as rotor or as stator of a motor. Correspondingly, the components 8.17 then functions as a stator or rotor so that 8.16 and 8.17 together form a motor 8.A. The component 8.17 is rigidly connected on its part with the flywheel mass 8.18. Further, the gear wheel 8.13 is rigidly connected with 8.12. The gear wheel 8.13 in turn meshes with the gear wheel 8.14. 8.13 and 8.14 form or represent a gear stage of the shed forming machine. The gear wheel 8.14 is rigidly mounted on the drive shaft 8.15 of the shed forming machine.

A brake 8.19 performs under normal operating condition the function of a holding brake for the shaft 8.7 and thus for 8.1. The brake 8.20 performs under normal operating condition the function of a holding brake for 8.12 and thus for 8.13 and 8.15. The brake 8.20 can be so constructed that additionally it also functions as a holding brake for 8.17 and thus for 8.18. The symbol M has the same meaning as in FIG. 1.

It is pointed out that on the one hand the components 8.8 with 8.7 and on the other hand the components 8.11 and 8.7 can be integrated with one another structurally as well as functionally so that the rotor or stator of the motor 8B is directly coupled with the main drive shaft 8.1 through 8.6 and so that on the other hand it is directly coupled with the rotor or stator of the motor 8 or even forms with it a unit from a manufacturing point of view.

For starting the arrangement according to FIG. 7, there are several possibilities. Thus, basically and in accordance with the principle described with reference to FIG. 4, the flywheel mass 8.10 may be accelerated first through the motor 8B and/or the flywheel mass 8.18 may be accelerated through the motor 8A respectively to a required r.p.m. in order to subsequently utilize their kinetic energy for starting the weaving machine, in case of 8.10, or for starting the shed forming machine in case of 8.18.

The following starting operation will be described. First, a simultaneous run-up takes place of 8.10 through motor 8B on the one hand, and with release of the brake 8.20 of the shed forming machine together with the flywheel mass 8.18 through the motor 8 on the other hand, i.e. motor 8 functions as a contactless coupling. The direction of rotation of 8.10 is opposite to the direction of rotation of the shed forming machine and of the flywheel mass 8.18. Upon completion of the run-up the brake 8.19 is opened and power is supplied to the motor 8B so that 8B has the tendency to bring the difference between the r.p.m.s of 8.7 and 8.10 to $0_{rads}^{-1}$ as described above with reference to FIG. 4. In this way 8.7 and thus the main drive shaft of the weaving machine are accelerated. This run-up of the weaving machine is supported by a simultaneous power supply to the motor 8 in such a way that its electrically produced torque moment causes a rotation of the components 8.11 and 8.12 and thus of the weaving and shed forming machines in opposition to each other. More specifically, 8.11 and 8.12 "repel" each other. The accelerations effective for the weaving machine and for the shed forming machine, respectively, have an inverse relationship to their mass inertia moments, in an otherwise loss free and force free system. If the motor 8A functions as a contactless coupling, then the mass inertia moment of the shed forming machine adds itself to that of 8.18. As a result, the sluggish shed forming machine is accelerated just a little to reach the operational r.p.m. while simultaneously a rapid run-up of the weaving machine is supported.

During current operation the motor 8 compensates the lost energies of the weaving machine and of the shed forming machine by an electrically produced torque moment which maintains the opposing motions of the weaving machine and the shed forming machine. In order to be able to vary the ratio of the accelerations of the weaving machine and of the shed forming machine, for example for adjusting the phase position of the machine angles of the weaving and shed forming machine relative to one another or if the type of binding needs to be changed, it is possible first to control or control in closed loop fashion the electrically produced torque moments of motor 8A and/or 8B or second to switch off one of the motors 8A or 8B. Thus, the ratio of the accelerations of the weaving machine to that of the shed forming machine can be varied, in the first instance, by producing counter-forces to the motor 8, and in the second instance, by changing the effective mass inertia moments of the weaving machine or shed forming machine. Upon reaching the desired phase position the motor 8A and/or 8B that in the meantime has been operated differently, has returned to the coupling operation.

Since the braking operation can take place basically as an inversion of the starting procedure, there are also several possibilities in this respect. By inverting the starting described in detail, the weaving machine is first stopped and thereupon the shed forming machine is stopped. However, a simultaneously stopping is also possible. For this purpose power is supplied to the motor 8 in such a way that it provides with the torque moment generated by the motor, a differential r.p.m. of $0_{rads}^{-1}$ between 8.11 or the shaft 8.1 of the weaving machine on the one hand and 8.12 on the other hand. Stated differently, 8.11 and 8.12 attract each other. Simultaneously power is supplied to the motors 8A and 8B in such a way that these motors support with their respective torque moments the braking operation of the weaving machine (motor 8B) or of the shed forming machine (motor 8A). Stated differently, the motors 8A and 8B function now the same way as motor 5A in FIG. 5 when that motor stops the weaving machine while having operated as a coupling during current operation. As was the case with the stopping of the weaving machine in FIG. 5 that, for low loss machines, a rise of the r.p.m. of the shed forming machine takes place, so here an increase, for low loss machines, of the r.p.m. of 8.10 takes place when the weaving machine is stopped and the r.p.m. of 8.18 increases when the shed forming machine is stopped. When the weaving machine is at standstill the brake 8.19 becomes effective. When the shed forming machine is at standstill the brake 8.20 becomes effective. Following the stopping of the weaving machine or the shed forming machine 8.10 or 8.18 can naturally run out or they may be slowly stopped through 8A or 8B with a respective small feedback power.

The motors and the actuating members allocated to the motors must transform the energy generated by the working machines through brake resistors into a heat loss. Alternatively, a generator operation may be performed, that is a useful braking action is permitted. More specifically and preferably, feeding back of energy into an electrical supply network and/or storage on capacitors and/or other energy storing types is possible. In the layout of the brake 8.20 it must be taken into account that it is a holding brake, however it must have a holding moment that is so large that it assures the standstill of the component 8.12 and of all components interlocked therewith against the acceleration moments effective during the run-up and against the deceleration moments effective during the stopping operation of 8.17 and 8.18. In the layout of the brake 8.19 it is to be taken into account that, although it is a holding brake, it must be capable to have a holding moment that is so large that it assures the standstill of the component 8.7 and of all components interlocked therewith against the acceleration moments effective during the run-up and the deceleration moments effective during the stopping again operation of 8.9 and 8.10 and depending on the type of operation of 8.12 to 8.16 or 8.12 to 8.18. Basically, it must be pointed out that the coordination of weaving machine and shed forming machine into a driving system can also be exactly inverse, more specifically 8.1 is the drive shaft of the shed forming machine while 8.15 is the main drive shaft of the weaving machine. The components 8.2 to 8.5 would in that case be connected with 8.15 while the gear means of the shed forming machine would be connected to 8.1.

Although the invention has been described with reference to specific example embodiments, it will be appreciated that it is intened to cover all modifications and equivalents within the scope of the appended claims. It should also be understood that the present disclosure include all possible combinations of any individual features recited in any of the appended claims.

What is claimed is:

1. A drive mechanism for a weaving machine and shed forming machine with means for compensating r.p.m. fluctuations of the drive of the weaving and shed forming machine, (a) wherein the weaving machine includes an electric motor drive which is connected directly or through intermediate gear means with its main drive shaft, (b) wherein the shed forming machine includes an electric motor drive which is connected directly or through intermediate gear means with its drive shaft, (c) wherein at least the weaving machine includes means for braking the main drive shaft;

(d) wherein a control unit is connected in a signal transmitting manner with the weaving- and the shed forming machine, (e) wherein the control unit includes closed loop control means for operating respectively one of said drives in dependency of the other of said drives, characterized in that said means for compensating comprise at least one partial flywheel mass (1.5, 1.11; 5.4, 5.14; 6.5, 6.16, 8.10, 8.18) which becomes effective on the main drive shaft (1.8; 5.7, 6.7, 8.1) of the weaving machine and at least one partial flywheel mass (2.5; 5.14; 6.5; 6.16; 8.10, 8.18) which becomes effective on the drive shaft (2.8; 5.17; 6.19; 8.15) of the shed forming machine or that gear means are provided which permit the mass inertia moment of at least one flywheel mass that is entrained for rotation with an electric motor drive (5, 5A; 6, 6A; 8, 8A, 8B) of the main drive shaft of the weaving machine, to become effective on the drive shaft (5.17; 6.19, 8.15) of the shed forming machine, that the drive of the weaving machine comprises a plurality of electric motor partial drives (5A; 6, 6A; 8, 8A, 8B) which are effective on the main drive shaft (5.7; 6.7, 8.1), that the drive of the shed forming machine is at least one of the electric motor partial drives 5A; 6, 6A; 8, 8A, 8B) which are effective on the main drive shaft (5.7; 6.7; 8.1), said at least one electric motor partial drive being operatively connected through the gear drive means, and in case of (8B) through drive (8) which functions as a contactless coupling, with the drive shaft of the shed forming machine, that the means for braking are preferably first brake means which are integrated into the partial drives, which bring the weaving machine to a standstill, that further second brake means (1.1; 4.5; 5.18; 6.18; 8.19) are allocated to the main drive shaft of the weaving machine, that third brake means (2.1; 5.19; 6.22; 8.20) are allocated to the drive shaft of the shed forming machine, and that all electric motor partial drives 1; 2, 5, 5A; 6, 6A; 8, 8A, 8B) are connected in a signal transmitting manner with the control unit.

2. The drive mechanism of claim 1, characterized in that the partial flywheel mass (1.5; 1.11) is respectively arranged at an end side of the main drive shaft (1.8) of the weaving machine and the partial flywheel mass (2.5) is arranged at an end side of the partial drive (2) allocated to the drive shaft (2.8) of the shed forming machine.

3. The drive mechanism of claim 1, characterized in that the partial flywheel masses (1.5, 1.11; 5.4, 5.14; 6.5, 6.16) are effective on the main drive shaft (1.8; 5.7; 6.7) as bodies of rotational symmetry having a homogenous density and an even mass distribution.

4. The drive mechanism of claim 1, characterized in that the partial flywheel masses (8.10; 8.18) are effective on the main drive shaft (8.1) as bodies of homogenous density and an uneven mass distribution.

5. The drive mechanism of claim 1, characterized int hat the mass inertia moment of at least one partial flywheel mass (5.14; 6.5; 6.16; 8.10; 8.18) allocated to and rotating with the main drive shaft (5.7; 6.7; 8.1) is transmittable to the drive shaft (5.17; 5.19; 8.15) of the shed forming machine through gear means (5.15, 5.16; 6.4, 6.20; 6.17, 6.21; 8.13, 8.14).

6. The drive mechanism of claim 5, characterized in that the gear means comprise a gear wheel (5.15; 6.4; 6.17; 8.13) connected to a first rotating component (5.13; 6.2; 6.14; 8.11) of the electric motor partial drive (5A, 6, 6A, 8) and a gear wheel (5.16; 6.20, 6.21; 8.14) rigidly secured to the drive shaft (5.17; 6.19; 8.15) of the shed forming machine, whereby both gear wheels (5.15, 5.16; 6.5, 6.20; 6.17, 6.21; 8.13, 8.14) mesh permanently.

7. The drive mechanism of claim 5, characterized in that the gear means have a transmission ratio that is variable in a stepless or stepped manner.

8. The drive mechanism of claim 1, characterized in that the second or third brake (1.1; 2.1; 5.18; 5.19; 6.18; 6.22; 8.19; 8.20) respectively allocated to the main drive shaft (1.8; 5.7; 6.7, 8.1) of the weaving machine and to the drive shaft (2.8; 5.17; 6.19; 8.15) of the shed forming machine is a holding brake rigidly arranged in the machine frame.

9. The drive mechanism of claim 1, characterized in that the first brake means are the electric motor partial drives themselves, which operate as a generator during a braking action.

10. The drive mechanism of claim 1, characterized in that the partial flywheel masses which become effective, can be decoupled from the shafts at least during braking.

11. The drive mechanism of claim 1, characterized in that the partial drives realize at any time intended controllable or in a closed loop manner controllable relative motions and intended controllable or in closed loop manner controllable torque moments between the respective flywheel mass and the allocated shaft.

12. The drive mechanism of claim 1, characterized in that the flywheel masses, which rotate along, comprise means for varying the size and/or characteristic of their mass inertia moment.

13. The drive mechanism of claim 1, characterized in that the becoming effective of at least one of the flywheel masses, which rotate along, on the main drive shaft of the weaving machine takes place through intermediate gear means.

14. The drive mechanism of claim 13, characterized in that said gear means form at least one compensating gear.

15. The drive mechanism of claim 14, characterized in that the compensating gear contains a transmission function which causes the coupling between the main drive shaft of the weaving machine and the flywheel mass, and wherein said transmission function contains, in a periodic characteristic a canceling of the coupling between the main drive shaft and the flywheel mass in a point by point and/or in an interval by interval manner.

16. The drive mechanism of claim 1, characterized in that the allocation of at least one of the flywheel masses, that rotates along, to the drive shaft of the shed forming machine takes place through intermediate gear means.

17. The drive mechanism of claim 16, characterized in that the intermediate gear means form at least one compensating gear.

18. The drive mechanism of claim 17, characterized in that the at least one compensating gear contains a transmission function which causes the coupling between the drive shaft of the shed forming machine and the flywheel mass, and wherein said transmission function contains in a periodic characteristic a canceling of the coupling between the main drive shaft and the flywheel mass in a point by point and/or in an interval by interval manner.

19. The drive mechanism of claim 12, characterized in that the means are connected in a signal transmitting manner with the control unit, whereby the means are preferably operated within closed loop control circuits.

20. The drive mechanism of claim 1, characterized in that the main drive shaft of the weaving machine is the rotor or stator of the at least one partial drive.

21. The drive mechanism of claim 1, characterized in that the drive shaft of the shed forming machine is the rotor or stator of the partial drive (5A).

22. A drive mechanism for a weaving machine with a main drive shaft and for a shed forming machine with a drive shaft and with means for compensating of r.p.m. fluctuations of the drive of the weaving machine and of the shed forming machine characterized by two components (5.12, 5.13; 6.2, 6.3; 6.14, 6.15; 8.8, 8.9; 8.11, 8.12; 8.16, 8.17) rotatable opposite to each other, wherein one component (5.13; 6.2; 6.14; 8.12) is connected either directly or through intermediate gear means (5.15, 5.16; 6.4, 6.20; 6.17, 6.21; 8.13, 8.14) with the drive shaft (5.17, 6.19; 8.15) of the shed forming machine, and wherein the other component (5.12; 6.3; 6.15; 8.8, 8.11) is connected either directly or through intermediate coupling means (5.10; 6.6; 6.12; 8.6) with the main drive shaft of the weaving machine, whereby the one component is alternately the stator and the respective other component is alternately the rotor of an electric motor drive (5.A; 6; 6A; 8, 8A, 8B).

23. The drive mechanism of claim 22, characterized in that the drive formed by the two components that are rotatable opposite to each other, performs the function of a standstill motor between the main drive shaft of the weaving machine and the drive shaft of the shed forming machine.

24. The drive mechanism of claim 22, characterized in that the drive formed by the two components that are rotatable opposite to each other, performs the function of a preferably synchronous coupling between the main drive shaft of the weaving machine and the drive shaft of the shed forming machine.

25. The drive mechanism of claim 22, characterized in that the drive formed by the two components that are rotatable opposite to each other, is suitable for the motor and for the generator operation.

26. The drive mechanism of claim 22, characterized in that the drive formed by the two components that are rotatable opposite to each other, permits in the current operation an adjustment of the phase position between the main drive shaft of the weaving machine and the drive shaft of the shed forming machine.

27. The drive mechanism of claim 25, characterized in that the drive are operable as a generator when the weaving machine and the shed forming machine are in a braking operation.

28. The drive mechanism of claim 22, characterized in that the two components which are rotatable opposite to each other, form at least one electric motor partial drive (5A; 6; 6A) at a first free end of the main drive shaft (5.7; 6.7) of the weaving machine.

29. The drive mechanism of claim 28, characterized in that additionally a further electric motor partial drive (5) can be coupled to a second free end of the main drive shaft (5.7; 6.7) of the weaving machine.

30. The drive mechanism of claim 29, characterized in that the further partial drive (5) comprises a stator (5.1) and a rotor (5.2), whereby the rotor (5.2) is connected through coupling means (5.3) with the main drive shaft (5.7; 6.7).

31. The drive mechanism of claim 28, characterized in that the drive shaft (5.17) of the shed forming machine is operatively connected through the gear means (5.15; 5.16) with the partial drive (5A) of the weaving machine.

32. The drive mechanism of claim 28, characterized in that the drive shaft (6.19) of the shed forming machine is operatively connected through the gear means (6.4; 6.20) with the partial drive (6) of the weaving machine.

33. The drive mechanism of claim 28, characterized in that the drive shaft (6.19) of the shed forming machine is operatively connected through gear means (6.4; 6.20; 6.17; 6.21) with the partial drives (6, 6A) of the weaving machine.

34. The drive mechanism of claim 22, characterized in that at least two first and two second components that are rotatable opposite to each other, form several electric motor partial drives (8, 8A, 8B) arranged at a free end of the main drive shaft (8.1) of the weaving machine.

35. The drive mechanism of claim 34, characterized in that the partial drive (8) comprises a component (8.11) rigidly connected with the shaft (8.7) and a component (8.12), that the partial drive (BA) comprises a component (8.17) rigidly connected to the component (8.12) of the partial drive (8), and that the partial drive (8B) comprises a further component (8.8) rigidly connected with the shaft (8.7) and a component (8.9) carrying a second flywheel mass (8.10).

36. The drive mechanism of claim 34, characterized in that the partial drive (8) is operatively connected through gear means (8.13, 8.14) with the drive shaft (8.15) of the shed forming machine.

37. The drive mechanism of claim 34, characterized in that the components (8.8, 8.9; 8.11, 8.12; 8.16, 8.17) alternately function as a stator or rotor of the partial drives (8, 8A, 8B).

38. The drive mechanism of claim 22, characterized in that the main drive shaft of the weaving machine is the rotor or stator of the at least one partial drive.

39. A drive mechanism for a drive shaft of a weaving machine and/or a shed forming machine, said drive shaft having a first end and a second end, and including means for compensating r.p.m. fluctuations of the drive of the weaving and/or the shed forming machine, characterized in that at least one electric motor drive (7) is operatively connected to the drive shaft (7.3) between the ends of the drive shaft (7.3), and wherein said at least one electric motor drive (7) comprises two components (7.4, 7.5) which are movable opposite to each other, wherein one component (7.5) of said components is directly connected with the drive shaft (7.3) and is electrically the stator or rotor of said at least one electric motor drive (7), and that the other component (7.4) is the rotor or stator of the drive (7), respectively reversed.

40. The drive mechanism of claim 39, characterized in that a rotational member (7.6) is rigidly connected with the rotor (7.4), said rotational member being connected in a force transmitting manner with a flywheel mass (7.9) which is arranged for rotating about a vertical axis (7.13).

41. The drive mechanism of claim 40, characterized in that the rotational member (7.6) and the flywheel mass (7.9) are constructed as friction wheel.

42. The drive mechanism of claim 41, characterized in that the friction wheels form a gear which is adjustable in a stepless manner.

43. The drive mechanism of claim 39, characterized in that said two components (7.4, 7.5) together form a linear motor.

44. The drive mechanism of claim 39, characterized in that said two components (7.4, 7.5) together form a revolving motor.

45. The drive mechanism of claim 39, characterized in that a revolving motion is produced in addition to the linear motion (7.4') between said two components (7.4, 7.5).

46. The drive mechanism of claim 39, characterized in that the drive shaft (7.3) is the main drive shaft of a weaving machine.

47. The drive mechanism of claim 39, characterized in that the drive shaft (7.3) is the drive shaft of a shed forming machine.

48. The drive mechanism of claim 14, characterized in that the flywheel mass(es) that rotates (rotate) along, completely compensates (compensate), through the at least one compensating gear, the r.p.m. fluctuations of the drive relative to the main drive of the weaving machine or relative to the drive shaft of the shed forming machine.

49. The drive mechanism of claim 17, characterized in that the flywheel mass(es) that rotates (rotate) along, completely compensates (compensate), through the at least one compensating gear, the r.p.m. fluctuations of the drive relative to the main drive of the weaving machine or relative to the drive shaft of the shed forming machine.

* * * * *